US009643231B2

(12) United States Patent
Flehmig

(10) Patent No.: US 9,643,231 B2
(45) Date of Patent: May 9, 2017

(54) METHOD AND DEVICE FOR PRODUCING FLANGED DRAWN PARTS WITH SIMULTANEOUS TRIMMING

(71) Applicant: ThyssenKrupp Steel Europe AG, Duisburg (DE)

(72) Inventor: Thomas Flehmig, Ratingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 469 days.

(21) Appl. No.: 14/062,412

(22) Filed: Oct. 24, 2013

(65) Prior Publication Data

US 2014/0047890 A1 Feb. 20, 2014

Related U.S. Application Data

(63) Continuation of application No. PCT/EP2012/057527, filed on Apr. 25, 2012.

(30) Foreign Application Priority Data

Apr. 29, 2011 (DE) ..... 10 2011 050 002

(51) Int. Cl.

| | |
|---|---|
| ***B21D 22/02*** | (2006.01) |
| ***B21D 22/22*** | (2006.01) |
| ***B21D 22/30*** | (2006.01) |
| ***B21D 24/16*** | (2006.01) |

(52) U.S. Cl.

CPC ..... *B21D 22/02* (2013.01); *B21D 22/22* (2013.01); *B21D 22/30* (2013.01); *B21D 24/16* (2013.01)

(58) Field of Classification Search

CPC ..... B21D 22/02; B21D 22/30; B21D 22/22; B21D 24/16; B21D 22/00; B21D 5/029

See application file for complete search history.

(56) References Cited

U.S. PATENT DOCUMENTS

| | | | | |
|---|---|---|---|---|
| 1,665,203 A * | 4/1928 | Delf | B21D 22/21 72/327 |
| 3,875,833 A * | 4/1975 | Kannegiesser | B23D 31/001 72/71 |
| 4,509,355 A * | 4/1985 | Oishi | B21D 28/32 225/103 |
| 6,038,910 A | 3/2000 | McClung | |

(Continued)

FOREIGN PATENT DOCUMENTS

| | | |
|---|---|---|
| CN | 1870320 A | 11/2006 |
| CN | 101758148 A | 6/2010 |

(Continued)

*Primary Examiner* — David Bryant
*Assistant Examiner* — Lawrence Averick
(74) *Attorney, Agent, or Firm* — Reinhart Boerner Van Deuren P.C.

(57) ABSTRACT

The invention relates to a device and method for producing flanged drawn members from a planar and/or pre-shaped plate of metal using a drawing punch having at least one cutting edge or rounded portion, a retention member and a drawing die, wherein the drawing die has a rib region, a flange region and a support region for the plate, the plate being placed on the support region of the drawing die and being shaped into the drawn member by the drawing punch being introduced into the drawing die and at the same time being cut at the flange region.

13 Claims, 3 Drawing Sheets

(56) References Cited

U.S. PATENT DOCUMENTS

| | | | | |
|---|---|---|---|---|
| 7,287,408 | B2 * | 10/2007 | Kawai | B21D 22/28 72/349 |
| 2006/0266092 | A1 * | 11/2006 | Kawai | B21D 22/28 72/349 |
| 2010/0133724 | A1 | 6/2010 | Flehmig et al. | |

FOREIGN PATENT DOCUMENTS

| | | | |
|---|---|---|---|
| DE | 102010000608 | B3 | 3/2011 |
| JP | 09-314243 | | 12/1997 |
| JP | H10314874 | A | 12/1998 |
| JP | 11-179446 | A | 7/1999 |
| SU | 1003970 | A1 | 3/1983 |
| WO | WO 2008/025387 | A1 | 3/2008 |

* cited by examiner

METHOD AND DEVICE FOR PRODUCING FLANGED DRAWN PARTS WITH SIMULTANEOUS TRIMMING

CROSS-REFERENCE TO RELATED PATENT APPLICATIONS

This patent application is a continuation of PCT/EP2012/057527, filed Apr. 25, 2012, which claims priority to German Application No. 102011050002.2, filed Apr. 29, 2011, the entire teachings and disclosure of which are incorporated herein by reference thereto.

FIELD OF THE INVENTION

The invention relates to a method for producing flanged drawn members from a planar and/or pre-shaped plate of metal using a drawing punch having at least one cutting edge or rounded portion, a retention member and a drawing die, the drawing die having a rib region, a flange region and a support region for the plate, the plate being placed on the support region of the drawing die and being shaped into the drawn member by the drawing punch being introduced into the drawing die and at the same time being cut at the flange region. In addition, the invention relates to a device for producing flanged drawn members having a drawing punch, which has at least one cutting edge or rounded portion, at least one retention member and a drawing die having a flange region in which the flange is shaped, a rib region and base region, in which the rib region and base region are shaped and a support region for the plate prior to the dra operation.

BACKGROUND OF THE INVENTION

There are known from the prior art methods and devices for producing flanged drawn members, by means of which drawn members can be produced from a planar plate by means of deep drawing and cutting in one operating stroke. It is thus known from the technical book "Schnitt-, Stanz- und Ziehwerkzeuge" (Cutting, Punching and Drawing Tools), Öhler und Kaiser, 8th edition (2001), to construct the drawing die, which comprises the base region, rib region and flange region of the drawn member to be produced, so as to be vertically displaceable in order, after the drawing operation which has been carried out, to cut the completed drawn member on the flange so that, as a result, the desired, flanged drawn member can be produced in one operating stroke of the drawing punch. A corresponding drawing die is illustrated on page 429 of the mentioned technical book. However, owing to the vertically displaceable drawing die, the structure of the cutting/drawing tool known from the prior art is relatively complex. There are further already in the prior art methods and corresponding devices for producing drawn members with integrated cutting which, in order to prevent abrasion of the flange region at the cutting edge of the drawing punch, carry out the cutting operation in a stretching/drawing step of the plate so that the material is subjected to a high tensile load during the cutting operation and the flange region accordingly follows the cut. Owing to the relatively uncontrolled following of the flange region, drawn members produced in this manner cannot be produced in a dimensionally precise manner with a high degree of process reliability. Finally, another problem is that the flange region additionally has to extend in an inclined manner relative to the rib region in order to prevent abrasion at the sharp cutting edge. An often desired right-angled path of the flange region relative to the rib region cannot be produced in one method step.

Deep-drawing presses have no high-precision tool guide so that cutting operations in such presses are not possible or can be carried out only with great difficulty and complexity.

SUMMARY OF THE INVENTION

An object of the present invention is therefore to provide a method and a device for producing flanged drawn members with process-integrated cutting which enable(s) more simple construction of the tool, a self-centering system and, at the same time, a process-reliable, dimensionally precise production of flanged drawn members.

According to a first teaching of the present invention, the object is achieved for a method in that the support region is constructed so as to be raised and fixed relative to the flange region, wherein the height difference corresponds at least to the wall thickness of the plate to be shaped, during the introduction of the drawing punch into the drawing die the cutting edge or rounded portion which is provided on the drawing punch moving into engagement with a rounded portion or cutting edge which is provided at the transition between the support region and flange region so that regions of the plate which project beyond the flange region are separated during the subsequent drawing operation.

Unlike the method known from the prior art, the support region is constructed according to the invention so as to be raised and fixed with respect to the flange region so that the tool can be generally constructed in a substantially simplified manner. Owing to the fact that the height difference between the support region and flange region of the die corresponds at least to the thickness of the plate, a correct cutting operation with the cutting edge of the drawing punch or the drawing die can be ensured. In addition, the fact that the at least one cutting edge or rounded portion provided on the drawing punch moves into engagement with the rounded portion or cutting edge provided between the support region and flange region before the end of the drawing operation, in contrast to the conventional method, enables the flange region to be cut before the end of the drawing operation. The method, thus, enables particularly simple construction of the tool, which has no vertically displaceable regions and provides a high level of flexibility of the arrangement of the flange. Via the height difference between the support region and flange region and via the flange region width, the introduction of the plate during the drawing operation can further be controlled or adjusted.

At the same time, owing to the cooperation between the cutting edge, for example, on the drawing punch and the opposing rounded portion on the drawing die, not only is there a positive effect on the cutting result, but also, owing to the self-centering effect, the advantage is afforded that the tool can be used in conventional deep-drawing presses, which generally have no exact and precise punch guide and the structure of the tool can thereby be kept simple.

According to a first embodiment of the method, the material flow during the drawing operation and the cutting can be controlled in an effective manner in that the retention member during the drawing and the cutting operation the region of the plate to be separated presses the region of the plate to be separated onto the support region of the drawing die. In particular, the tensile load of the plate during the cutting operation can thereby be adjusted and consequently the cutting quality can be influenced. When a wide retention member and a wide support face of the drawing die are used, the semi-finished product can in particular be clamped in a fold-free manner and ironed.

According to a next embodiment of the method, the rounded portion has along the cutting line a varying engagement depth with the cutting edge of the drawing punch or the drawing die, the plate starting from the regions of the rounded portions that are first in engagement with the cutting edge of the drawing punch or the drawing die continuously being cut when the drawing punch is introduced into the drawing die. Unlike the method known from the prior art, in which the cutting of the plate is simultaneously carried out after the end of the drawing operation over the entire length of the cutting line, the cutting forces and the cutting impact can be substantially reduced. This is because the engagement depth which varies along the cutting line with the cutting edge of the drawing punch or the drawing die of the rounded portion ensures that the cutting edge of the drawing punch moves into engagement with the rounded portion at different times or positions of the drawing punch so that the cutting of the plate first begins in the regions of the rounded portion which are first in engagement and then continues to propagate in the direction of the other regions. The cutting line formed by the rounded portion with the cutting edge may then, for example, have an undulating path or an inclined path.

Preferably, the rounded portion has a radius of at least 0.5 mm. In order to increase the precision of the cutting of the plate during the drawing operation, it is advantageous for a cutting edge having a radius of a maximum of 0.5 mm to be used.

The same also applies to the next embodiment of the method according to the invention in which a cutting gap of from 0.05 mm to a maximum of 0.2 mm is complied with between the rounded portion and cutting edge of the drawing punch or the drawing die.

Owing to the cooperation of the cutting edge (sharp edge) with the rounded portion, regardless of whether it is provided on the drawing punch or preferably on the drawing die, the tool is constructed in a self-centering manner and thereby has a positive influence on the cutting quality.

According to another embodiment of the method according to the invention, the dimensional accuracy of the flanged drawn members produced can be further improved by the plate being drawn, before the drawing operation in the drawing die, in a pre-drawing die in a pre-mould and the pre-shaped plate providing a material excess so that, when the end position of the drawing punch is reached, the completely shaped and cut plate is calibrated. The material excess may preferably be provided in the base region and/or in the drawing radius. Consequently, owing to these two operating steps, that is to say, pre-shaping and end-shaping and cutting, a highly dimensionally accurate, flanged drawn member can be provided using simple means.

Finally, the method can be further improved in that the plate is hot-formed in the drawing die. Naturally, this also optionally applies to the pre-shaping process. During hot-forming, the plates are heated to austenisation temperature, hot-formed and rapidly cooled so that the drawn member is press-hardened. The hot-forming operation in general produces, on the one hand, smaller shaping forces, on the other hand, a structure which is advantageous for the shaping and which allows large degrees of shaping. In particular, the hot-forming is used with plates of higher-strength or extremely high-strength steels, for example, of the type 22MnB5.

Alternatively, in accordance with another embodiment of the method according to the invention, it is also possible to partially leave material along the cutting line, preferably in the form of webs, that is to say, to produce an interrupted cutting line, whereby the drawn member is at least partially still connected to the cutting region and at the same time can be removed from the tool (waste discharge via webs). In another separation process, the cutting region can be separated from the good portion.

According to another embodiment of the method according to the invention, a "slotted semi-finished product" can be used which in the cutting region has at least one slot, preferably at least two slots, which extend(s) from an edge of the semi-finished product as far as the cutting line, whereby, during the cutting operation, the cutting region breaks up into a plurality of individual portions (waste separation) and the bad portion can thereby be removed from the tool in a more simple manner, for example, by means of waste chutes.

According to a second teaching of the present invention, the object set out is achieved by a device in that the support region is constructed so as to be raised and fixed relative to the flange region, wherein the height difference between the support region and the flange region of the drawing die corresponds at least to the wall thickness of the plate to be shaped, there being provided between the support region and the flange region a rounded portion or cutting edge which is in engagement with a cutting edge or rounded portion provided on the drawing punch and which enables a cutting of the plate during the drawing operation. The device according to the invention, thus, does not have a vertically displaceable drawing die so that the costs for the production of the tool can be significantly reduced. Furthermore, the height difference between the support region of the plate and the flange region enables the flange of the drawn member to be able to be shaped in a very precise manner in the flange region after it has been cut. In addition, the device enables greater flexibility to be achieved with regard to the orientation of the flange region with respect to the rib region. The cost-effective tool with its simple structure reduces wear and consequently also the costs for producing precise, flanged drawn members.

If the height difference between the support region and the flange region of the drawing die corresponds at least to the wall thickness of the plate to be shaped, the introduction of the flange region of the drawn member can be controlled or adjusted via the height difference or via the flange region width. A greater height difference between the support region and the flange region enables more material to be able to be provided in this region and enables the flange region to have a lesser introduction. Of course, a minimum introduction must be ensured so that the drawn member which has been drawn can still be removed from the tool.

In order to improve the cutting quality when the rounded portion engages with the cutting edge, and in order to achieve improved self-centering of the system on the drawing punch/drawing die, it is advantageous for the rounded portion to have an entry radius of at least 0.5 mm.

According to another embodiment of the device according to the invention, the precision of the cutting of the flange of the drawn member is improved in that the cutting edge of the drawing punch or the drawing die has a radius of a maximum of 0.5 mm.

The same also applies to the next embodiment of the device according to the invention, according to which a cutting gap of from 0.05 mm to a maximum of 0.2 mm is provided between the cutting edge and the rounded portion.

The cutting edge and the rounded portion may be provided either on the drawing punch or in the drawing die.

In order to reduce the cutting forces but also the cutting impact during the drawing operation, according to another embodiment of the device according to the invention the rounded portion along the cutting line has a varying engagement depth with the cutting edge so that the cutting edge at the beginning of the cutting operation is only locally or partially in engagement with the rounded portion. Again, the rounded portion or the cutting edge may either be provided on the drawing punch or in the drawing die. As already set out in relation to the method, the rounded portion which varies, for example, in terms of the engagement depth thereof with the cutting edge, allows a continuous cut along the cutting line by means of introduction of the drawing punch into the drawing die. Consequently, the cutting forces and the cutting impact are significantly reduced during the drawing operation.

Finally, the device according to the invention can be further improved in that the support region is connected to the drawing die in a highly precise manner, for example, by means of pinning, or is constructed integrally with the drawing die. If the support region is constructed integrally with the drawing die, the drawing die can be produced in a particularly cost-effective manner. On the other hand, there are significant advantages with respect to the maintenance when the support region is pinned to the drawing die. In this instance, it is possible to exchange the support region and optionally re-process the rounded portion or the cutting edge of the drawing die in a simple manner.

The object of providing a method and a device for producing flanged drawn members with process-integrated cutting which enable(s) more simple construction of the tool, a self-centering system and, at the same time, process-reliable, dimensionally precise production of flanged drawn members, is achieved for a method in that the support region is constructed so as to be raised and fixed relative to the flange region, wherein the height difference corresponds at least to the wall thickness of the plate to be shaped, during the introduction of the drawing punch into the drawing die the cutting edge or rounded portion provided on the drawing punch moving into engagement with a rounded portion or cutting edge provided at the transition between the support region and flange region so that regions of the plate which project beyond the flange region are separated during the subsequent drawing operation.

BRIEF DESCRIPTION OF THE DRAWINGS

The invention is now intended to be explained in greater detail with reference to embodiments and the drawings, in which.

DETAILED DESCRIPTION OF THE INVENTION

Figure 1:
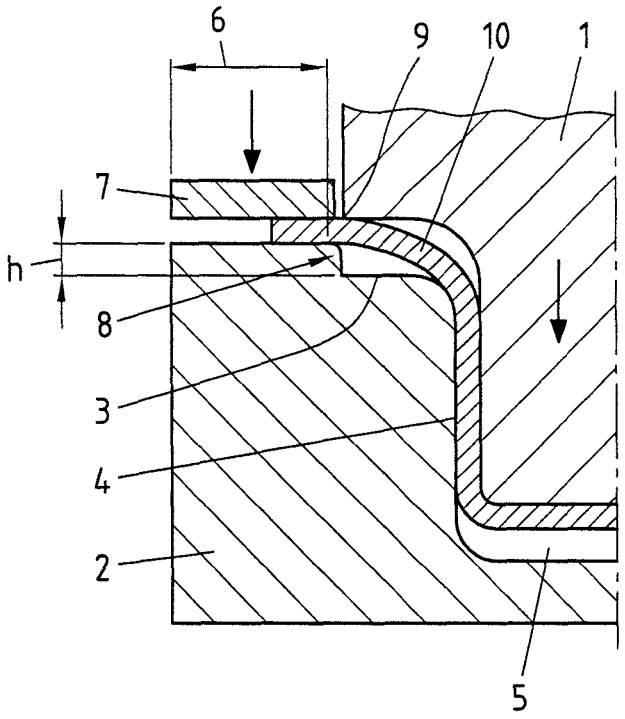
FIG. 1 is a schematic sectioned view of a half of a first embodiment of a device according to the invention, with the drawing operation not yet being completed.

FIG. 1 first shows a first embodiment of a device according to the invention for producing flanged drawn members with a drawing punch 1, a drawing die 2 having a flange region 3 in which the flange is shaped, a rib region 4 and a base region 5, in which the rib or base regions of the drawn member are formed, and a support region 6 for supporting the plate prior to the drawing operation. In addition, the device has a retention member 7 and a rounded portion 8 between the support region 6 and the flange region 3. The rounded portion has an entry radius of at least 0.5 mm so that the material can flow in an unimpeded manner from the support region 6 into the flange region. The support region 6 is raised with respect to the flange region 3 and is constructed in a fixed manner. h indicates the height difference between the support region for the plate of the drawing die 6 and the flange region 3 of the drawing die. In the embodiment shown, h is slightly larger than the plate thickness. The directional arrows each show the movement direction of the retention member 7 and the drawing punch 1.

The drawing punch 1 further has a cutting edge 9 which preferably has a radius of 0.05 mm. As illustrated in FIG. 1, the plate 10 is drawn into the drawing die during the drawing operation until the cutting edge 9 moves into engagement with the rounded portion 8. Preferably, the retention member is moved downwards at the beginning of the drawing operation so that it presses the plate 10 against the support region 6 of the plate. The material flow can thereby be additionally controlled during the drawing operation.

Figure 2:
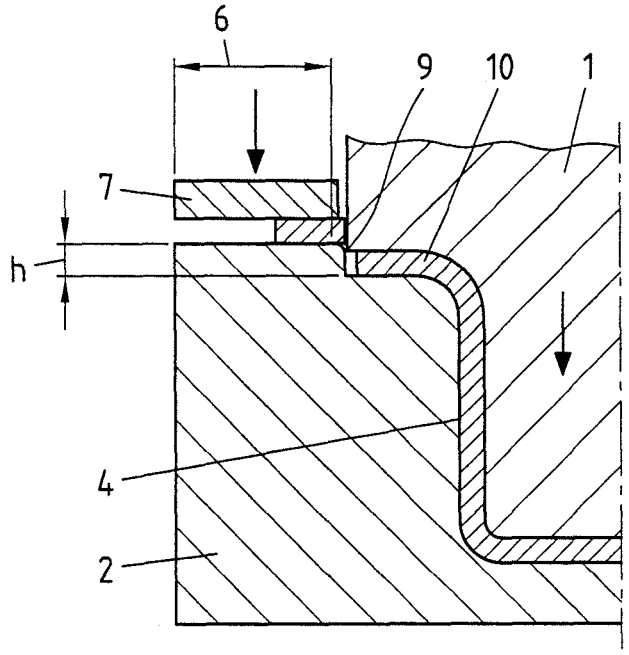
FIG. 2 shows the embodiment of FIG. 1 when the end position of the drawing punch is reached.

If the drawing die 1, as shown in FIG. 2, moves into the end position, the plate is cut owing to the engagement of the cutting edge 9 of the drawing punch 1 with the rounded portion 8 of the support region 6 so that portions of the plate 10 extending beyond the flange region 3 are separated from the plate 10. As can be seen in FIGS. 1 and 2, the drawing die 2 is constructed in a particularly simple manner and nonetheless allows deep drawing with simultaneous cutting of the plate. In the present embodiment, the support region 6 is constructed integrally with the drawing die, which corresponds to a particularly simple embodiment. However, it is also conceivable for the support region 6 to be produced by means of a replaceable insert which is connected to the drawing die in a highly precise manner, for example, by means of pinning. In this instance, the replacement and re-processing of the rounded portion 8, which is of course subjected to wear, can be carried out in a particularly simple manner.

Figure 3:
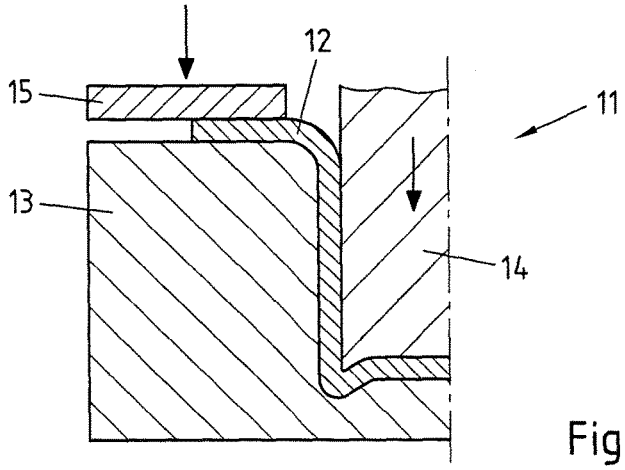
FIG. 3 is a schematic sectioned view of one half of an embodiment of a device for producing a pre-mould in the end position of the pre-drawing punch.

FIG. 3 is a schematic sectioned view of one half of a device 11 for producing a pre-shaped plate 12, which produces a material excess, for example, in the base region. The device 11 for producing a pre-shaped plate also comprises a die 13 and a drawing punch 14 and a retention member 15.

Figure 4:
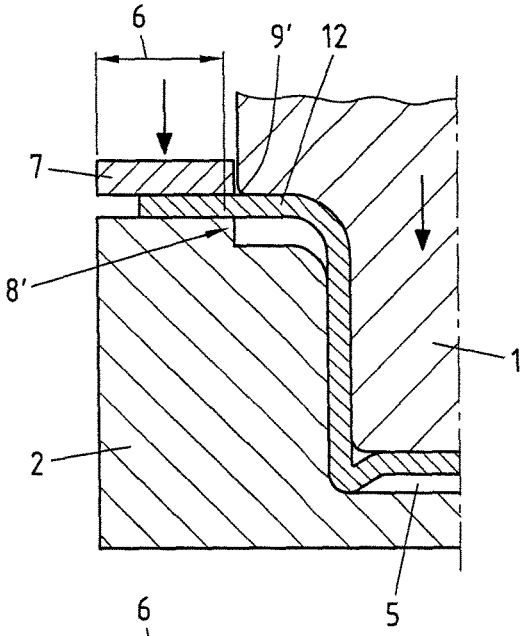
FIG. 4 is a schematic sectioned view of one half of a second embodiment of a device according to the invention when the pre-shaped plate from FIG. 3 is used.
Figure 5:
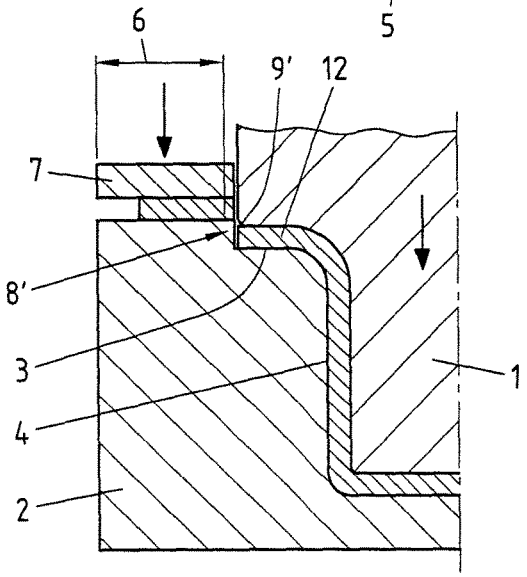
FIG. 5 shows the embodiment from FIG. 4 when the end position of the drawing punch is reached.

If, as schematically illustrated in FIGS. 4 and 5, the plate 12 which is pre-shaped in this manner, is placed in the device according to a second embodiment, the pre-shaped plate 12 can not only be drawn to the final shape but can also at the same time be cut and calibrated. The material excess of the pre-shaped plate provided in the base region 5 of the drawing die ensures this. The difference with respect to the device shown in FIGS. 1 and 2 is that a cutting edge 8' is provided on the drawing die 2 between the support region 6 and flange region 3 and a rounded portion 9' is provided on the drawing punch 1.

As shown in FIG. 4, the engagement of the cutting edge with the entry contour is carried out before the drawing operation is complete.

FIG. 5 is a schematic view of the embodiment of a device according to the invention in the end position of the drawing punch having a calibrated, pre-shaped plate 12. The introduction of the plate into the flange region is minimal and the drawn member produced in this manner is consequently very dimensionally precise.

Figure 6:
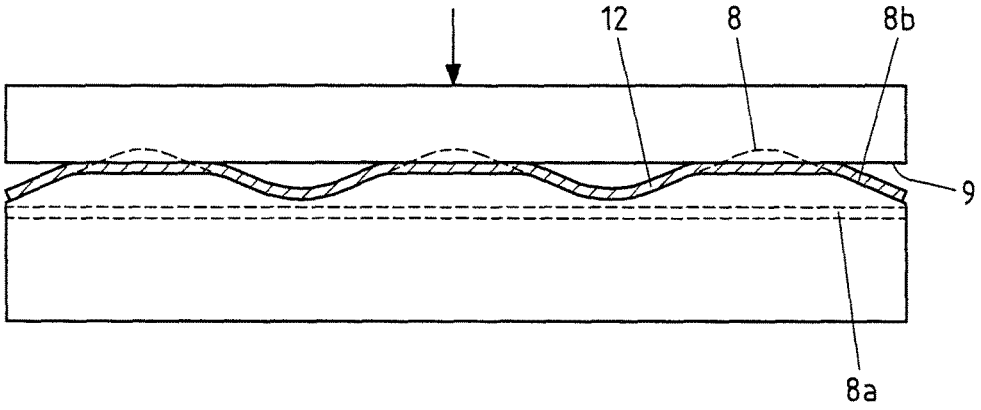
FIG. 6 is a schematic sectioned view of the path of the curvature of the support region according to a third embodiment.

FIG. 6 schematically illustrates the rounded portion 8 between the support region 6 and flange region 3 along the cutting line 8*b* thereof. The cutting line 8*b* of the rounded portion 8 has an undulating extent so that the cutting edge 9 of the drawing punch at the beginning of the cutting operation moves into engagement with the rounded portion 8 only locally or partially and the plate can be continuously cut by the drawing punch being introduced into the drawing die. The desired cutting contour of the rounded portion 8 which corresponds to the desired dimension of the plate is designated 8*a*. The illustration in FIG. 6 is not to scale. By means of calibration, as shown, for example, in FIGS. 4 and 5, the rounded portion can be corrected in a simple manner in one operating step.

Figure 7:
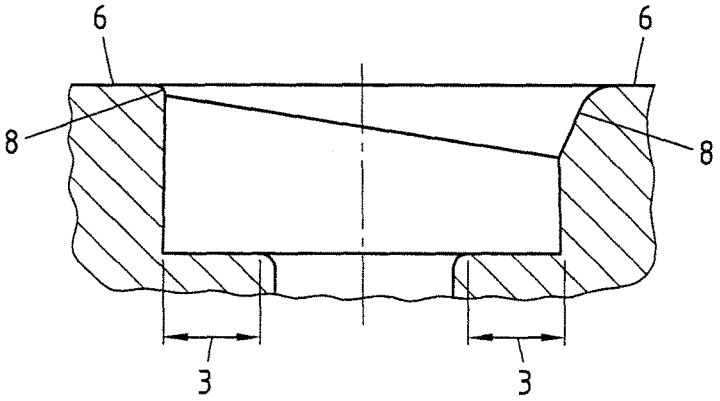
FIG. 7 is a schematic sectioned view of a fourth embodiment of an entry contour having varying form.

Other paths of the rounded portion are also further possible. For example, a saw-tooth-like or linear path of the engagement depth of the rounded portion can be used. This is shown schematically, for example, in FIG. 7. In FIG. 7, at the left-hand side, the rounded portion 8 has a small entry radius, for example, of 1 mm. In contrast, at the right-hand side, the entry radius is substantially larger, for example, 5 mm. The cutting edge accordingly first moves into engagement with the left-hand side and continues its cut at the right-hand side by the drawing punch being introduced into the die.

The cutting gaps which are provided between the cutting edge 9, 8' and rounded portion 8, 9', are preferably from 0.05 mm to a maximum of 0.2 mm in order to ensure a particularly precise cut of the plate. Furthermore, the cutting edge of the drawing punch or the drawing die preferably has a radius of a maximum of 0.5 mm in order to also ensure a particularly precise cutting operation. Consequently, particularly precise flanged drawn members with low investment costs for the die can be provided using the device according to the invention.

The invention claimed is:

1. Method for producing flanged drawn members from a planar and/or pre-shaped plate using a drawing punch having at least one cutting edge or rounded portion, a retention member and a drawing die, wherein the drawing die has a rib region, a base region, a flange region and a support region for the plate, the method comprising the steps of:

placing the plate on the support region of the drawing die;

drawing the plate into a drawn member by introducing the drawing punch into the drawing die and cutting at the flange region;

wherein the support region is constructed so as to be raised and fixed relative to the flange region;

wherein the height difference between the support region and flange region corresponds at least to the wall thickness of the plate to be shaped; and wherein during the introduction of the drawing punch into the drawing die, the at least one cutting edge provided on the drawing punch moves into engagement with a rounded portion which is provided at the transition between the support region and flange region, or the at least one rounded portion provided on the drawing punch moves into engagement with a cutting edge provided at the transition between the support region and flange region so that regions of the plate which project beyond the flange region are separated during the drawing operation.

2. Method according to claim 1, wherein during the drawing operation and the cutting of the plate, the retention member presses the region of the plate to be separated onto the support region of the drawing die.

3. Method according to claim 1, wherein the rounded portion has along a cutting line a varying engagement depth with the cutting edge and the plate, starting from the regions of the rounded portion that are first in engagement with the cutting edge, and wherein the plate is continuously cut when the drawing punch is introduced into the drawing die.

4. Method according to claim 1, wherein a cutting edge having a radius of a maximum of 0.5 mm is used.

5. Method according to claim 1, wherein a cutting gap of from 0.05 mm to a maximum of 0.2 mm is complied with between the rounded portion and cutting edge.

6. Method according to claim 1, wherein the plate, before being drawn in the drawing die, is drawn in a pre-drawing die into a pre-shaped plate and the pre-shaped plate provides a material excess so that, when the end position of the drawing punch is reached, the completely shaped and cut plate (12) is calibrated.

7. Method according to claim 1, wherein the plate is hot-formed in the drawing die.

8. Device for producing flanged drawn members, the device comprising:

a drawing punch which has at least one retention member;

a drawing die having a flange region in which a flange of the flanged drawn member is shaped, a rib region and base region, in which a rib region and a base region of the flanged drawn member are shaped, and a support region for supporting a plate prior to drawing the plate into a flanged drawn member in a drawing operation;

wherein the support region is constructed so as to be raised and fixed relative to the flange region;

wherein the height difference between the support region and the flange region of the drawing die corresponds at least to the wall thickness of the plate to be shaped, wherein a round portion is provided between the support region and the flange region of the die, the round portion being in engagement with a cutting edge provided on the drawing punch or, wherein the cutting edge is provided between the support region and flange region wherein the cutting edge is in engagement with the rounded portion which is provided on the drawing punch and enables cutting of the plate during the drawing operation.

9. Device according to claim 8, wherein the rounded portion has an entry radius of at least 0.5 mm.

10. Device according to claim 8, wherein the cutting edge has a radius of a maximum of 0.5 mm.

11. Device according to claim 8, wherein a cutting gap of from 0.05 mm to a maximum of 0.2 mm is provided between the cutting edge and the rounded portion.

12. Device according to claim 8, wherein the rounded portion has along a cutting line a varying engagement depth with the cutting edge so that the cutting edge at the beginning of the cutting operation is only locally or partially in engagement with the rounded portion.

13. Device according to claim 8, wherein the support region is connected to the drawing die in a highly precise manner or is constructed integrally with the drawing die.

* * * * *